US005718732A

United States Patent [19]

Bennett et al.

[11] Patent Number: 5,718,732

[45] Date of Patent: Feb. 17, 1998

[54] EXHAUST DYEING

[75] Inventors: Brian Bennett, deceased, late of Buttershaw; Peter Bennett, administrator, Idle, both of England

[73] Assignee: Clariant Finance (BVI) Limited, Tortola, Virgin Islands (Br.)

[21] Appl. No.: 675,025

[22] Filed: Jul. 3, 1996

[30] Foreign Application Priority Data

Jul. 4, 1995 [GB] United Kingdom ..... 9513585

[51] Int. Cl.[6] ..... D06P 3/24; D06P 1/39

[52] U.S. Cl. ..... 8/582; 8/602; 8/604; 8/597; 8/917; 8/924

[58] Field of Search ..... 8/602, 604, 597–9, 8/582, 924, 917

[56] References Cited

U.S. PATENT DOCUMENTS 2,294,246 8/1942 Schniepp et al. ..... 8/582
4,252,531 2/1981 Daeuble et al. ..... 8/531

FOREIGN PATENT DOCUMENTS 716990 10/1954 United Kingdom .
1350297 4/1974 United Kingdom .
1553520 9/1979 United Kingdom .
2140470 11/1984 United Kingdom .

OTHER PUBLICATIONS

Hannay, et al "The Use of Hydrolysable Esters in the Control of Dyebaths", *Journal Soc. Dyers & Colourists*, Jun. 1953 pp. 195–201.

*Primary Examiner*—Margaret Einsmann
*Attorney, Agent, or Firm*—Hesna J. Pfeiffer; Scott E. Hanf

[57] ABSTRACT

A process of dyeing natural or synthetic polyamide fibres in an aqueous exhaustion dyebath comprising an anionic dyestuff, comprising the steps of 1. immersing the fibres to be dyed in the aqueous dyebath which has a temperature of from 20°–50° C. and a pH of 7–11 (7–8.5 when the polyamide is wool); and
2. raising the temperature to 110° C. maximum and maintaining it there until exhaustion is substantially complete;

there being added to the dyebath, either prior to the commencement of temperature raising or after an alkaline migration period at the boil, an ester of a $C_2$–$C_3$ hydroxycarboxylic acid with a $C_2$–$C_6$ glycol and up to 30% by weight of the ester of a tertiary amine which is essentially non-volatile under the process conditions.

18 Claims, 4 Drawing Sheets

Figure 1:
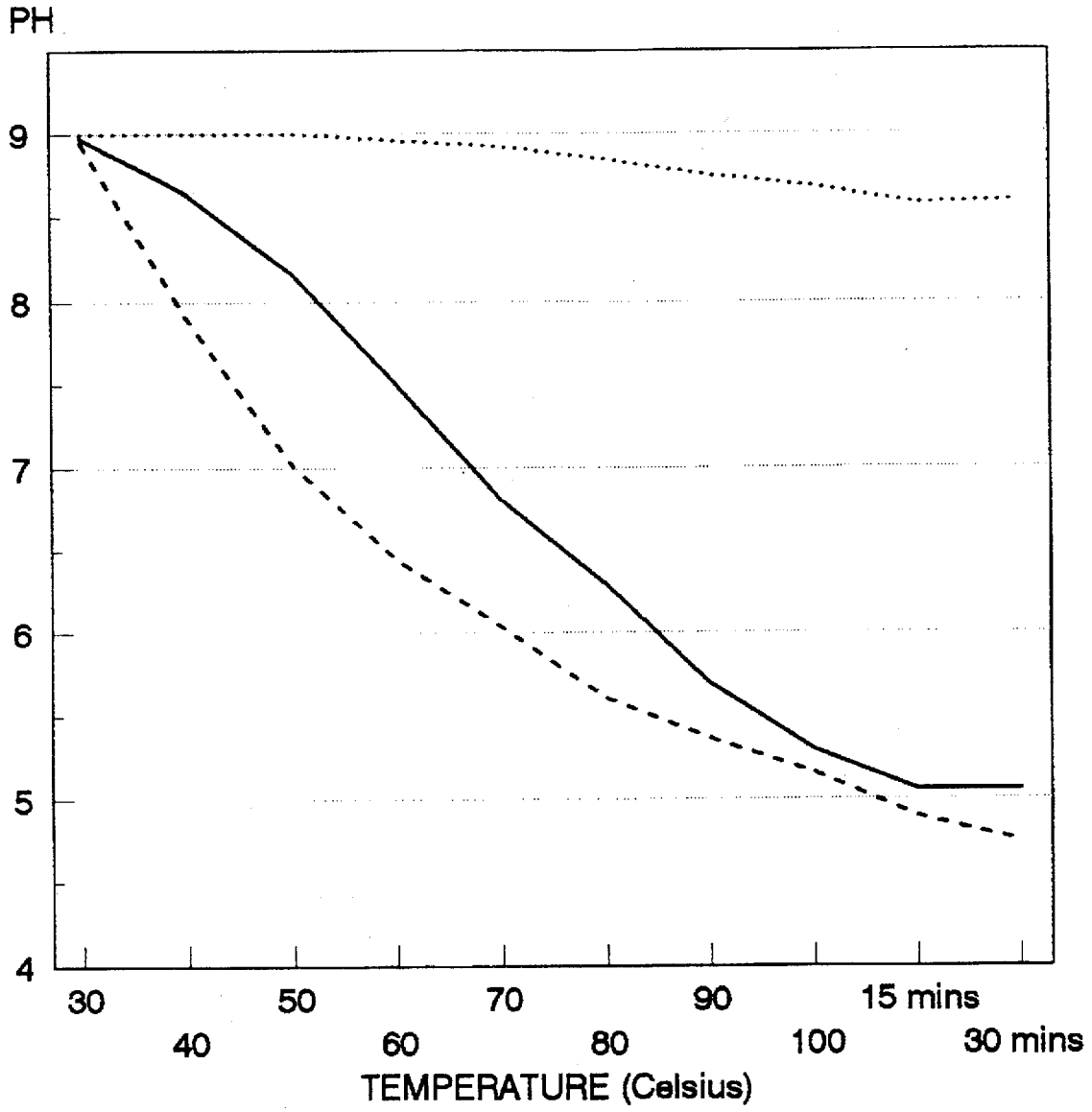

PH COURSE WITH RISING TEMPERATURE - 0.25G/L gamma-Butyrolactone

.....

Ethylene Glycol Diglycolate 90%
Triethanolamine 10%

———

Formic acid + 1.5 mols ETO

- - - - -

Buffered to pH9 with Borax

PH COURSE WITH RISING TEMPERATURE - 0.5G/L gamma-Butyrolactone

Ethylene Glycol Diglycolate 90%
Triethanolamine 10%

Ethylene Glycol Diglycolate 80%
Triethanolamine 20%

Formic acid + 1.5 mols ETO

Buffered to pH9 with Borax

PH COURSE WITH RISING TEMPERATURE - 0.5G/L gamma-Butyrolactone

.....

Ethylene Glycol Diglycolate 96.5%
Triethanolamine 3.5%

———

Formic acid + 1.5 mols ETO

- - - - -

Buffered to pH9 with Borax

PH COURSE WITH RISING TEMPERATURE - 1.0G/L gamma-butyrolactone

Ethylene Glycol Diglycolate 80%
Triethanolamine 20%

Formic acid + 1.5 mols ETO

Buffered to pH9 with Borax

EXHAUST DYEING

This invention relates to the dyeing of polyamide textile materials.

In the dyeing of polyamides which may be natural (such as wool) or synthetic (such as nylon) by anionic dyestuffs by the exhaustion method, the normal procedure is to add the polyamide to be dyed to a dyebath with a pH which is neutral-medium alkaline (7.0–8.5 for natural polyamides, 7.0–10.0 for synthetic polyamides). The dyebath is raised to the boil and boiling is continued ha order to obtain exhaustion of the dyestuff and penetration of the fibre. In order to achieve best results, the initial pH should be in the region of 7–10 (for wool 7–8.5), and there should be a gradual lowering of pH until a final pH of about 4–5 is reached. Known methods such as the use of acids or acid donors (typically acetic acid, formic acid, ammonium sulphate and ammonium acetate) are not entirely satisfactory because the resulting dyeing is often unlevel.

An alternative group of materials is that of hydrolysable esters and lactones, such as butyrolactone and formic acid glycol esters. With these compounds the results are better, but they are not without problems. For example, butyrolactone gives a final pH which is too high and the dyebath is not always fully exhausted, leading to a waste of material. On the other hand, the use of formic acid glycol ester gives a hydrolysis rate which is too rapid at the commencement of dyeing, leading to too low a pH too soon and the possibility of unlevel dyeing.

It has now been found that the use of certain materials can lead to good exhaustion and level dyeing. There is therefore provided, according to the present invention, a process of dyeing polyamide fibres in an aqueous exhaustion dyebath comprising an anionic dyestuff, comprising the steps of 1. immersing the fibres to be dyed in the aqueous dyebath which has a temperature of from 20°–50° C. and a pH of 7–11 (7–8.5 when the polyamide is wool); and
2. raising the temperature to 110° C. maximum and maintaining it there until exhaustion is substantially complete, there being added to the dyebath, either prior to the commencement of temperature raising or after an alkaline migration period at the boil, an ester of a $C_2$–$C_3$ hydroxycarboxylic acid with a $C_2$–$C_6$ glycol and up to 30% by weight of the ester of a tertiary amine which is essentially non-volatile under the process conditions.

The invention additionally provides a dyeing assistant for use with polyamide fibres, the assistant comprising an ester of a $C_2$–$C_3$ hydroxycarboxylic acid with a $C_2$–$C_6$ glycol and a tertiary amine which is essentially non-volatile in the range 100°–110° C., the ester:tertiary amine ratio being from 70:30–95:5 by weight of active ingredients.

It should be noted that, where a component is referred to in the singular in this specification, the possibility of there being a plurality of such components is also encompassed, unless otherwise specified.

The acid component of the ester may be selected from hydroxyacetic and hydroxypropionic acids. Mixtures of these acids may also be used, as may any of the possible isomeric forms.

The glycol component may also be chosen from any of the materials known to the art, such as ethylene glycol, diethylene glycol, triethylene glycol, propylene glycol, butylene glycol, pentane diol and hexamethylene glycol. Mixtures of such glycols may be used.

The tertiary amine may be selected from any suitable tertiary amine which is essentially non-volatile under the process conditions, that is, a small degree of volatility is permissible. Examples of suitable amines include triethanolamine and triisopropanolamine. It is preferred that the tertiary amine be present, such that the ratio of ester to amine (by weight of active ingredients) is from 70:30–95:5, preferably from 80:20–90:10. The ester and tertiary amine (when present) are used such that their combined quantities are from 0.05– 10 parts, preferably from 0.25–0.1 parts, by weight actives per 1,000 parts dyebath. The two materials may be added separately or together. In many cases, the blend may be sufficiently fluid, in other cases viscosity may be lowered by addition of a small proportion (typically 5–15%) of an art-recognised solvent. A typical suitable solvent is butyl polyglycol.

In the process of the present invention, the dyebath is prepared and the ester (and, when desired, the tertiary amine) is added to the dyebath. The pH is adjusted to the required value (7–11 for synthetics, 7–8.5 for wool). The fibres to be dyed are then added and the temperature is increased slowly to a maximum of 110° C. (preferably 80°–100° C., especially when dyeing wool) and maintained there until bath exhaustion is complete. The quantity of the dye used is that recognised by the art, and special features of the invention are that the dye exhaustion is very good, and that dyeings are very even. A further significant feature of the invention is the degree of control over rate and extent of pH change given by this invention. The higher the level of tertiary amine, the lower the rate of decrease of the pH. Thus, for any given polyamide, the skilled person may with some experimentation easily determine a composition which gives the optimum performance. In an alternative procedure, the ester (and, when desired, the tertiary amine) are added to the bath after a suitable alkali migration period has passed. The term "alkali migration period" is well understood in the art, and it relates to the fact that dyeing in such processes may be started at an alkaline pH (at which the dyestuff has low affinity for the fibre) at low temperature—this means that the dyestuff will migrate during this period of alkaline pH and penetrate more thoroughly into the fibre than would otherwise be the case. The temperature is then gradually raised to the final dyeing temperature, at which point the ester is added. This will gradually hydrolyse and lower the pH as it does so. This will ensure exhaustion of the dyestuff on to the fibre (the affinity of the dyestuff for the fibre being higher at acid pH), at the good penetration mentioned hereinabove. The technique is especially useful where the fibre is in the form of tightly-twisted yams or dense fabrics.

Figure 2:
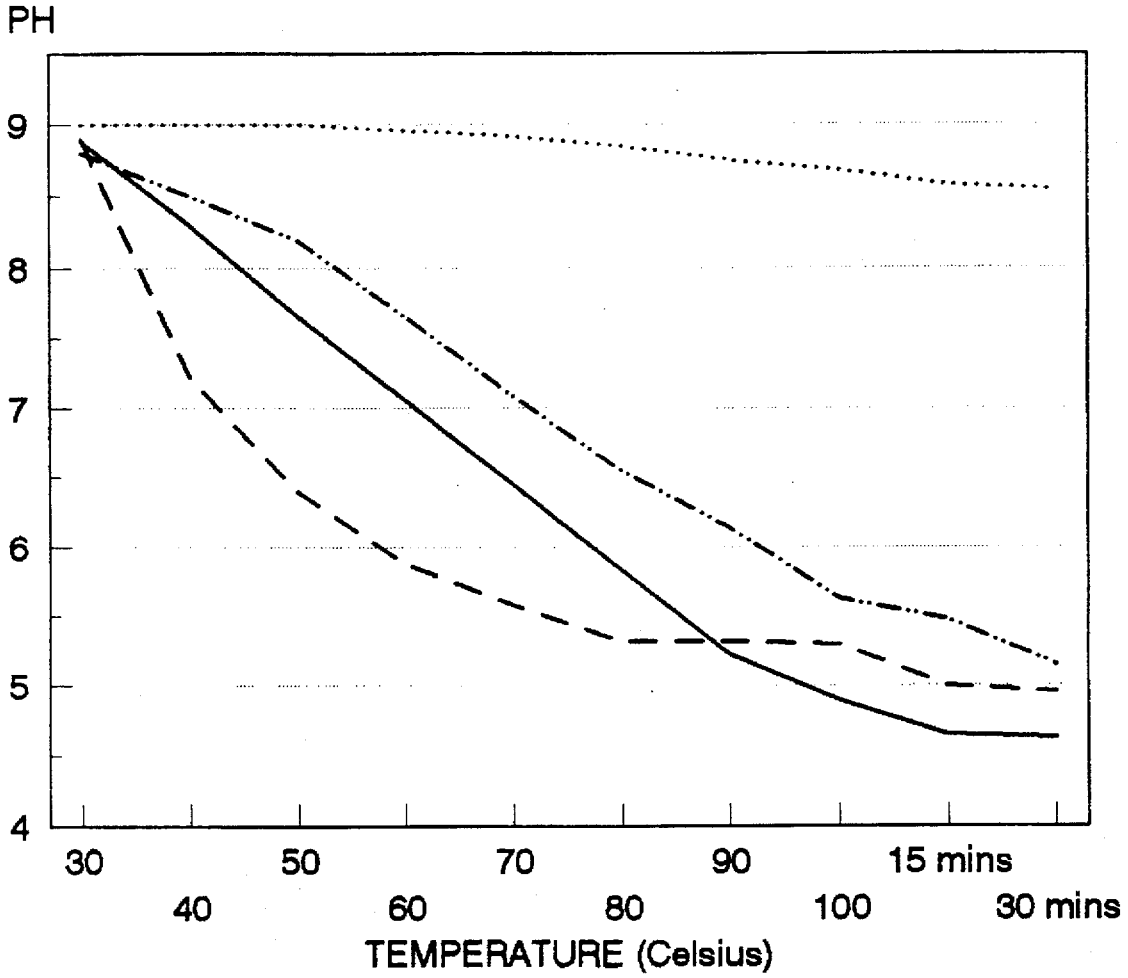
Figure 3:
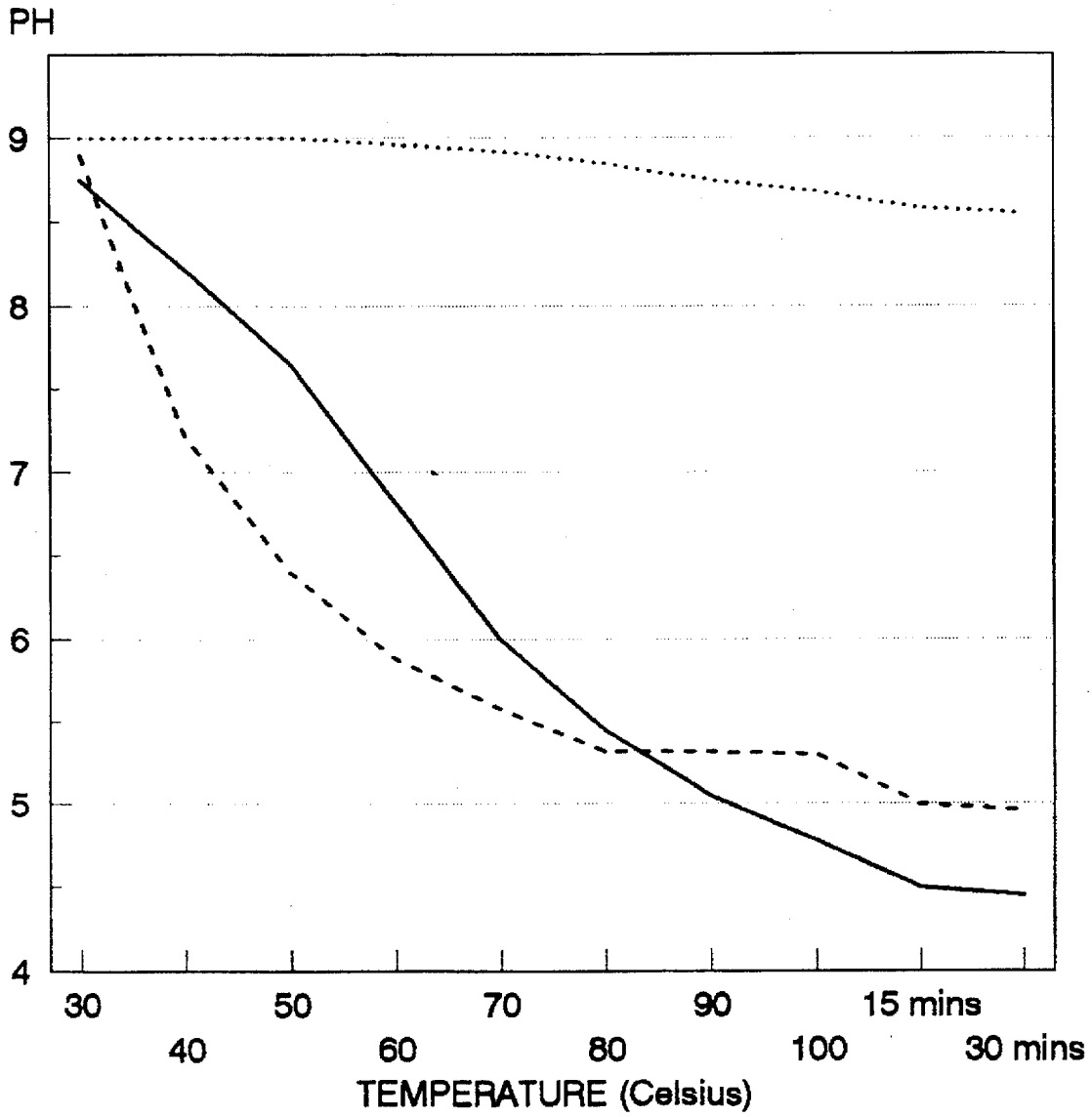
Figure 4:
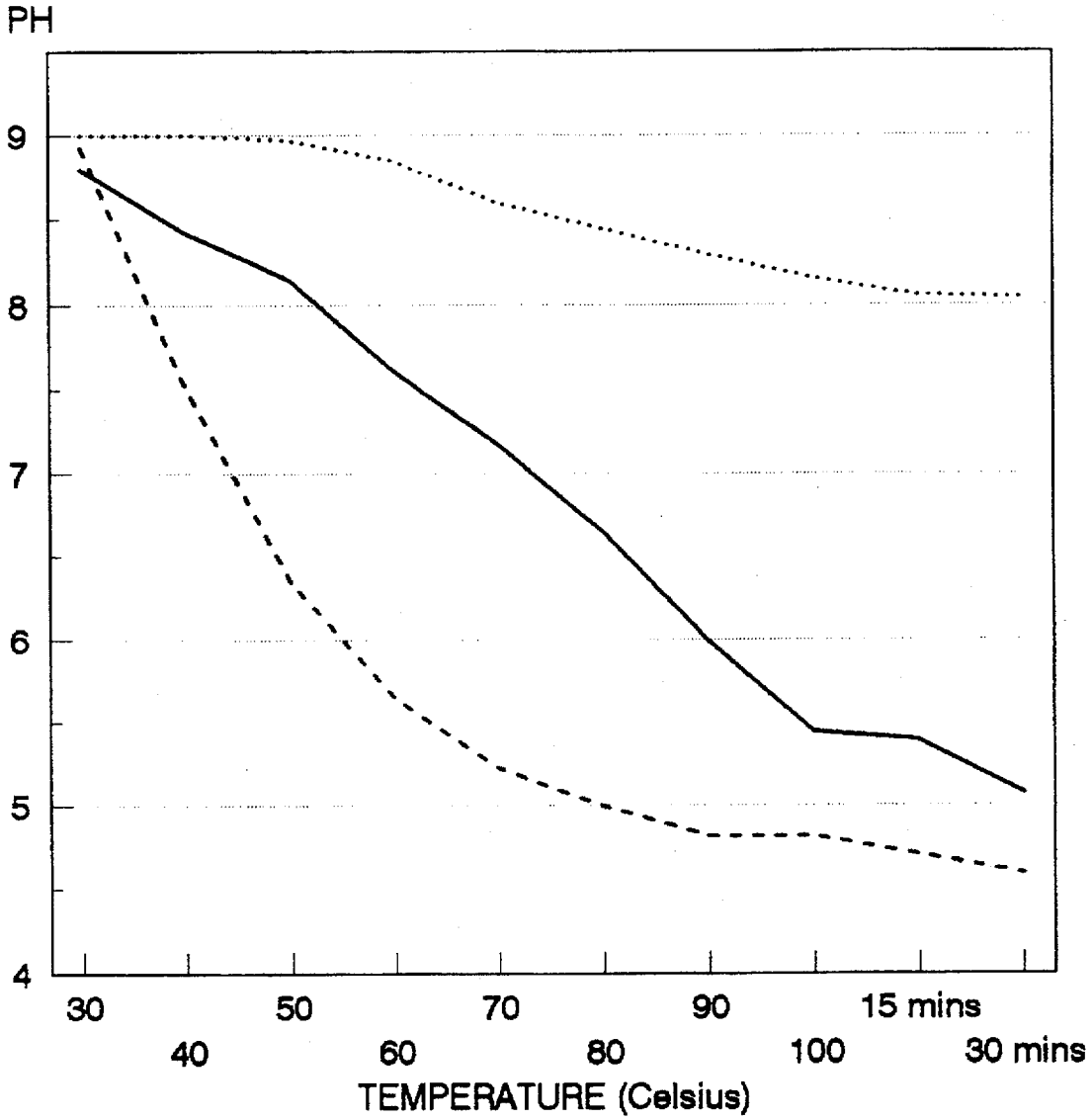

The invention is further illustrated by reference to the following examples and to FIGS. 1–4 which are graphical representations of pH changes observed in the performance of Example 1.

EXAMPLE 1

Demonstration of pH Control

The following materials were used

A—butyrolactone

B—formic acid+1.5 mol ethylene oxide

C—96.5% ethylene glycol diglycolate+3.5% triethanolamine

D—90% ethylene glycol diglycolate+10% triethanolamine

E—80% ethylene glycol diglycolate+20% triethanolamine.

Each of these materials is incorporated into water to form a bath and the pH is buffered to 9 with borax. The temperature of the bath is then raised by 1 deg. C./minute and the pH is monitored. The pH values are as shown in the table. The materials are tested at different concentrations, for example, Material A is tested at 0.25, 0.5 and 1.0 g/liter in the bath. The results are also depicted graphically in FIGS. 1–4.

and E are more even than those obtained from the bath with Material B and have better exhaustion than the bath with Material A. In addition, the rate of strike of dyestuff is slower with increased concentration of triethanolamine in C, D and E, confirming again the results of Example 1.

| Temp. °C. | 0.25 g/l A | 0.25 g/l B | 0.25 g/l D | 0.5 g/l A | 0.5 g/l B | 0.5 g/l C | 0.5 g/l D | 0.5 g/l E | 1.0 g/l A | 1.0 g/l B | 1.0 g/l E |
|---|---|---|---|---|---|---|---|---|---|---|---|
| 30 | 9.0 | 8.95 | 8.98 | 9.0 | 8.9 | 8.75 | 8.88 | 8.8 | 9.0 | 8.93 | 8.8 |
| 40 | 9.0 | 7.91 | 8.64 | 9.0 | 7.22 | 8.22 | 8.3 | 8.5 | 9.0 | 7.51 | 8.43 |
| 50 | 9.0 | 7.02 | 8.17 | 9.0 | 6.4 | 7.65 | 7.66 | 8.2 | 8.47 | 6.35 | 8.15 |
| 60 | 8.96 | 6.45 | 7.61 | 8.96 | 5.88 | 6.82 | 7.06 | 7.66 | 8.85 | 5.65 | 7.61 |
| 70 | 8.92 | 6.04 | 6.81 | 8.92 | 5.58 | 6 | 6.45 | 7.09 | 8.6 | 5.23 | 7.18 |
| 80 | 8.85 | 5.61 | 6.3 | 8.85 | 5.32 | 5.45 | 5.83 | 6.55 | 8.45 | 5.0 | 6.66 |
| 90 | 8.75 | 5.37 | 5.7 | 8.75 | 5.32 | 5.05 | 5.23 | 6.14 | 8.3 | 4.82 | 6.0 |
| 100 | 8.68 | 5.16 | 5.3 | 8.68 | 5.3 | 4.78 | 4.9 | 5.63 | 8 16 | 4.82 | 6.46 |
| 100 after 15 mins. | 8.58 | 4.9 | 5.06 | 8.58 | 5 | 4.5 | 4.65 | 5.45 | 8.06 | 4.71 | 5.4 |
| 100 after 30 mins. | 8.6 | 4.75 | 5.06 | 8.55 | 4.96 | 4.45 | 4.63 | 5.15 | 8.05 | 4.6 | 5.08 |

For the graphs, several things are noticeable:

1. the slow pH decline brought about by Material A (butyrolactone)
2. the very rapid initial pH drop and subsequent levelling out brought about by Material B (formic acid+1.5 mol ethylene oxide).
3. the even, almost straight-line decline of pH brought about by Materials C, D and E.
4. the change of inclination of the graphs C, D and E with changing proportion of triethanolamine.

Thus, the materials according to the invention, C, D and E, are intermediate in their behaviour between the art-recognised materials A and B and show a much more desiderable pH decline. Moreover, the ability to regulate the speed of this decline by means of the proportion of triethanolamine present gives the ability to tailor the system to an individual dyestuff and application.

EXAMPLES 2 AND 3

A series of dyebaths is prepared in which the following recipes are used (percentages are by weight of the total dyebath).

| | | |
|---|---|---|
| Example 1 | Acid Orange 127 | 0.06% |
| | Acid Red 336 | 0.05% |
| | Acid Blue 350 | 0.35% |
| Example 2 | Acid Orange 127 | 0.08% |
| | Acid Red 336 | 0.10% |
| | Acid Blue 350 | 0.20% |

The dyebaths additionally contain 1.0% by weight of the fibre of tallow amine ethoxylated with 35 moles of ethylene oxide and 0.5 g/liter of each of Materials A, B, C, D and E as hereinabove described. These baths are used to dye fibres of Nylon 66 at a liquor to goods ratio of 20:1 by adding the fibre to the bath and raising the bath temperature at a rate of 1 deg. C./minute. Dyeings are commenced at 30° C. after the pH of the bath is adjusted to 9 with borax and fibre samples are removed at 50° C., 60° C., 75° C., 90° C. and 100° C. and 100° C. again after 30 minutes.

The dyeings comfirm the results of Example 1, in that the dyeings obtained in the baths which include Materials C, D It is claimed:

1. A process of dyeing nylon polyamide fibers in an aqueous exhaustion dyebath comprising an anionic dyestuff, comprising the steps of 1. immersing the fibers to be dyed in the aqueous dyebath which has a temperature of from 20°–50° C. and a pH of 7–11; and
2. raising the temperature to 110° C. maximum and maintaining it there until exhaustion is substantially complete;

there being added to the dyebath, either prior to the commencement of temperature raising or after an alkaline migration period at the boil, an ester of a $C_2$–$C_3$ hydroxycarboxylic acid with a $C_2$–$C_6$ glycol and up to 30% by weight of the ester of a tertiary amine which is essentially non-volatile under the process conditions.

2. A process according to claim 1, wherein the hydroxycarboxylic acid is selected from hydroxyacetic acid and hydroxypropionic acid.

3. A process according to claim 1, wherein the glycol is selected from ethylene glycol, diethylene glycol, triethylene glycol, propylene glycol, butylene glycol, pentane diol and hexamethylene glycol.

4. A process according to claim 1, wherein the ratio of ester to amine (by weight of active ingredients) is 70:30–95:5.

5. A process according to claim 1, wherein the ester and tertiary amine are used such that their combined quantities are from 0.05–10 parts by weight actives per 1,000 parts dyebath.

6. A process according to claim 1, wherein the ester and the tertiary amine are added to the bath after a suitable alkali migration period has passed.

7. A process according to claim 1, wherein the tertiary amine is not present.

8. A process according to claim 4, wherein the ratio of ester to amine (by weight of active ingredients) is 80:20–90:10.

9. A process according to claim 5, wherein the ester and tertiary amine are used such that their combined quantities are from 0.25–0.1 parts by weight actives, per 1,000 parts dyebath.

10. A process of dyeing wool polyamide fibers in an aqueous exhaustion dyebath comprising an anionic dyestuff, comprising the steps of 1. immersing the fibers to be dyed in the aqueous dyebath which has a temperature of from 20°–50° C. and a pH of 7–8.5; and
2. raising the temperature to 110° C. maximum and maintaining it there until exhaustion is substantially complete;

there being added to the dyebath, either prior to the commencement of temperature raising or after an alkaline migration period at the boil, an ester of a $C_2$–$C_3$ hydroxycarboxylic acid with a $C_2$–$C_6$ glycol and up to 30% by weight of the ester of a tertiary amine which is essentially non-volatile under the process conditions.

11. A process according to claim 10, wherein the hydroxycarboxylic acid is selected from hydroxyacetic acid and hydroxypropionic acid.

12. A process according to claim 10, wherein the glycol is selected from ethylene glycol, diethylene glycol, triethylene glycol, propylene glycol, butylene glycol, pentane diol and hexamethylene glycol.

13. A process according to claim 10, wherein the ratio of ester to amine (by weight of active ingredients) is 70:30–95:5.

14. A process according to claim 10, wherein the ester and tertiary amine are used such that their combined quantities are from 0.05–10 parts by weight actives per 1,000 parts dyebath.

15. A process according to claim 10, wherein the ester and the tertiary amine are added to the bath after a suitable alkali migration period has passed.

16. A process according to claim 10, wherein the tertiary amine is not present.

17. A process according to claim 13, wherein the ratio of ester to amine (by weight of active ingredients) is from 80:20–90:10.

18. A process according to claim 14, wherein the ester and tertiary amine are used such that their combined quantities are from 0.25–0.1 parts by weight actives, per 1,000 parts dyebath.

* * * * *